United States Patent [19]

Baumberg

[11] Patent Number: 4,527,956

[45] Date of Patent: Jul. 9, 1985

[54] PIPE FOR ELEVATING LIQUID, AND DEVICE PROVIDED THEREWITH

[76] Inventor: Iosif Baumberg, 54 Bay 29 St., Brooklyn, N.Y.

[21] Appl. No.: 605,129

[22] Filed: Apr. 30, 1984

[51] Int. Cl.[3] ..... F04F 1/06

[52] U.S. Cl. ..... 417/65; 417/118; 417/121

[58] Field of Search ..... 417/65, 108, 109, 121, 417/92, 103, 104, 118, 110–117, 90

[56] References Cited

U.S. PATENT DOCUMENTS 932,934 8/1909 Wood ..... 417/108

2,983,229 5/1961 Went ..... 417/109

3,215,087 11/1965 McLeod ..... 417/92 X 4,135,364 1/1979 Busick ..... 417/108 X

*Primary Examiner*—Edward K. Look

*Attorney, Agent, or Firm*—Ilya Zborovsky

[57] ABSTRACT

A pipe for elevating a liquid by liquid portions separated by gas gaps has a plurality of passages each having an inner diameter selected so as to form a stable meniscus film at the borders between the liquid portions and the gas portions and each having a plurality of successively arranged wall portions wettable and non-wettable by the liquid.

5 Claims, 12 Drawing Figures

"AA"

PIPE FOR ELEVATING LIQUID, AND DEVICE PROVIDED THEREWITH

BACKGROUND OF THE INVENTION

The present invention relates to a pipe for elevating liquids, and to a device provided therewith.

It is known to elevate liquids in an elevating pipe to a predetermined height under the action of a pressure differential which is smaller than the pressure of an uninterrupted column of liquid with a height equal to the predetermined elevation height. For this purpose portions of liquid in the pipe are in alternating sequence with gas gaps or bubbles. The portions of liquid assume the shape of piston-like bars with side surfaces which coincide with the inner surfaces of the pipe, and with end surfaces formed by films of surface tension on the liquid-gas border or film meniscuses. Such pipes and devices are disclosed, for example, in the U.S. Pat. Nos. 532,699, 556,436, 566,987, 580,540, 597,023, 1,154,745, 1,343,693, 1,741,571, 1,811,295, and U.S. patent application No. 441,740. The disadvantage of the known devices for elevating a liquid is the limitation of the inner diameter of the pipe and of movement speed of elevated liquid portions by such values which guarantee the stability of the formed liquid portion or piston-like bars separated by gas gaps. For example, if the liquid to be elevated is water and the separating gas is air, the stability of the water portion in the pipe of glass can be guaranteed when the inner diameter of the pipe is smaller than 4 mm. The limitation of the inner diameter of the pipe by the value guaranteeing the stability of the formed liquid portions prevents practical utilization of these devices.

SUMMARY OF THE INVENTION

Accordingly, it is an object of the present invention to provide a pipe for elevating a liquid and an elevating device therewith, which avoid the disadvantages of the prior art.

More particularly, it is an object of the present invention to provide a pipe for elevating a liquid and an elevating device which is designed so that the pipe can have an unlimited inner diameter and elevate a liquid by separate portions separated from one another by gas gaps or bubbles.

In keeping with these features and with others which will become apparent hereinafter, one feature of the present invention resides, briefly stated, in a pipe for elevating a liquid which has a plurality of elongated passages extending in an elevation direction and each having a cross sectional area such that a stable meniscus film is formed between each liquid portion and a neighboring gas portion in each of the passages, and each of the passages has a wall including a plurality of wall portions wettable by the liquid and a plurality of wall portions non-wettable by the liquid, wherein each wettable wall portion is located prior to the respective non-wettable wall portion as considered in direction of elevation of the liquid.

In accordance with another feature of the present invention, when the passages are interrupted and passage portions are formed in liquid-permeable partitions with openings, the wall bounding each opening has at least one wettable wall portion and at least one nonwettable wall portion following the former in the direction of elevation of the liquid.

The novel features of the invention are set forth in the appended claims. the invention itself will be best understood from the following description which is accompanied by the following drawing.

DESCRIPTION OF PREFERRED EMBODIMENTS

A pipe for elevating liquids in accordance with the present invention has a plurality of elongated passages extending in a direction of elevating and each having an inner diameter selected so as to form a stable meniscus film at the interface of liquid portions with gas gaps or bubbles. For lifting of water separated by air gaps in a glass pipe each of the elongated passages must have an inner diameter which does not exceed 4 mm.

Figure 1:
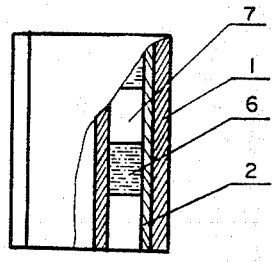
FIG. 1 is a side view of a pipe for elevating liquids in accordance with the present invention.
Figure 2:
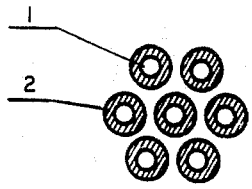
FIG. 2 is a plan view of the elevating pipe shown in FIG. 1.

As can be seen from FIGS. 1 and 2, the elongated passages 1 can be formed by a plurality of tubular members which extend in the direction of elevation and are uninterrupted along their length. The tubular members are located adjacent to one another in a direction transverse to the direction of elevation and can be connected with one another by known methods.

Figure 3:
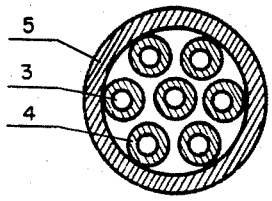
FIG. 3 is a plan view of the elevating pipe in accordance with another embodiment.

FIG. 3 shows an elevating pipe which has a plurality of elongated passages 3 formed by a plurality of pipes 4, wherein the pipes 4 are surrounded by a tubular casing 5. In the tubular members 2 and 4 or in the elongated passages 1 and 3, the liquid is elevated by piston-like portions 6 separated from one another by gas gaps or bubbles 7. Meniscus films are formed on the borders of the liquid portions 6 and gas portions 7.

Figure 4:
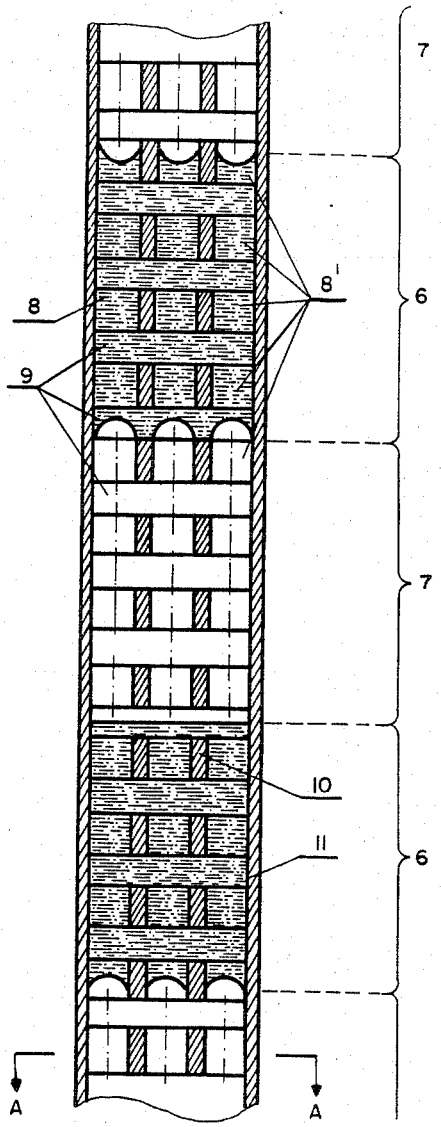
FIG. 4 is a sectional view of an elevating device with an elevating pipe of a further embodiment.

FIG. 4 shows a pipe for elevating liquid in an elevating device. The pipe here has elongated passages 8 which are interrupted along their length so as to form a plurality of passage portions 8'. The passages portions 8' of each elongated passage 8 are separated from one another by intermediate chambers 9. As can be seen from FIG. 4 one passage portion of all elongated passages can be formed in a grate-like partition 10. The pipe can be provided with an outer casing 11. The partition 10 is not necessarily to be formed grate-like. It can also be formed of a porous material such as for example foam plastic, or a loose material, for example sand or balls etc.

The pipe with the interrupted elongated passages of FIG. 4 has the following advantages as compared with the pipe having uninterrupted passages of FIG. 1. The liquid level in all passages is equalized in the chambers 9 between the partitions 10. Non-uniformity of height of liquid elevation in various passages, which can be caused by different resistance of the passages, results in leading of the liquid discharge from one of several passages and eqiulization of pressure between the lower and upper bases of the liquid portion up to a complete discharge from the pipe of the whole elevated liquid. The total resistance in such a pipe to the liquid flow is lower than in the pipe composed of the uninterrupted tubular members, since in the pipe of FIG. 4 the liquid flows not through the tubular members of a small cross section, but through a total cross section of the pipe. The pipe of FIG. 4 has a lower weight than the pipe of FIG. 1.

Figure 5:
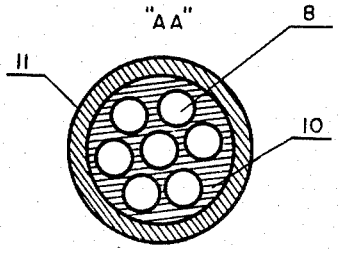
FIG. 5 is a plan view of the elevating pipe of FIG. 4.
Figure 6:
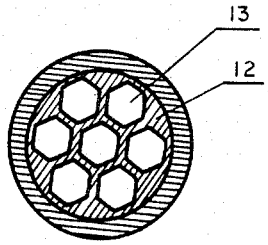
FIG. 6 is a view substantially corresponding to the view of FIG. 5 but showing still a further embodiment of the invention.

In the pipe shown in FIG. 4 it is advantageous if the total volume of all openings or passage portions in each grate member 10 is higher than the volume of the chamber 9 between two grate members. As can be seen from FIG. 5, the grate member 10 can have circular openings or passage portions 8. In contrast, the grate member or partition 12 shown in FIG. 6 can have a honeycomb shape with a plurality of hexagonal openings or passage portions 13. Such a partition has an optimal utilization of its surface area.

Figure 7:
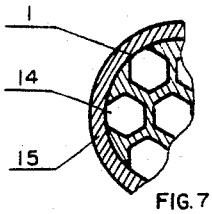
FIG. 7 is a view substantially corresponding to the view of FIG. 6, but showing a somewhat different elevating pipe.
Figure 8:
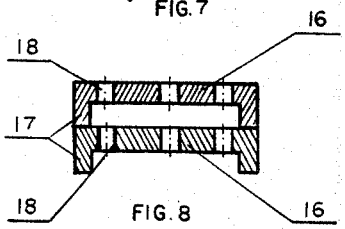
FIGS. 8 and 9 are views showing arrangement of portions of the elevating pipe in two additional embodiments.
Figure 9:
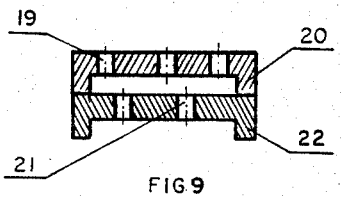

As can be seen from FIG. 7, the outer hexagonal openings 14 in a partition of a honeycomb shape can be outwardly open and limited by a pipe casing 15. FIG. 8 shows partitions 16 which are provided with two legs 17 to stand on each other. Openings or passage portions 18 of these partitions are in alignment with one another. In contrast, openings 19 of a partition 20 shown in FIG. 9 are not in alignment with openings 21 of a partition 22 of the same pipe.

FIG. 4 also shows that the elevation device including the inventive elevating pipe is inserted into a liquid source and is connected with a source of pressure, such as a pump.

Each of the elongated passages 1, 3, 8, 13, 14, 18, 19 and 21 can be formed so that each of the elongated passages is bounded by a wall which has a plurality of wall portion wettable by the liquid to be elevated and a plurality of wall portions non-wettable by the liquid arranged so that each wettable portion is located prior to each non-wettable wall portion as considered in the elevating direction. This improves the process of elevating of the liquid, since each wettable wall portion causes adherence of the liquid to it, then a next non-wettable wall portion pushes the liquid further upwardly to a next wettable wall portion to which the liquid adheres again.

Figure 10:
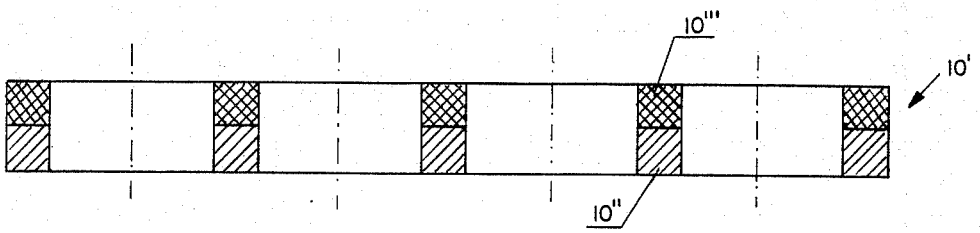
FIG. 10 shows an elevating pipe with liquid-permeable partitions formed in accordance with another feature of the invention.

FIG. 10 shows one modification of the elevating pipe with successive wettable and non-wettable wall portions. In the shown construction the lower part of a grate-like partition 10' is formed of a wettable material, whereas the upper part is formed of a non-wettable material. These parts are identified with reference numerals 10'' and 10''', respectively. The lower part 10'' can be composed of a metal, wherein the lower part 10''' can be composed of teflon, if the liquid to be elevated is water.

Figure 11:
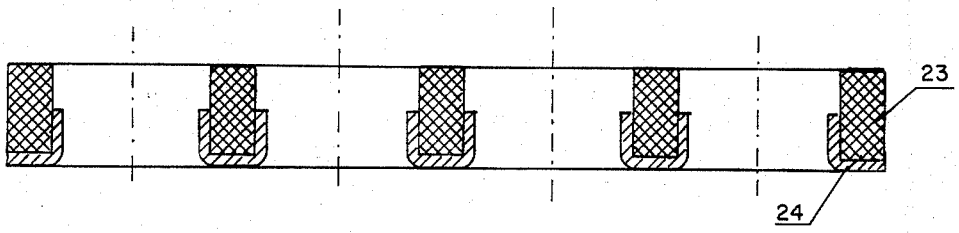
FIGS. 11 and 12 are views showing the liquid-permeable partitions in accordance with two further embodiments.
Figure 12:
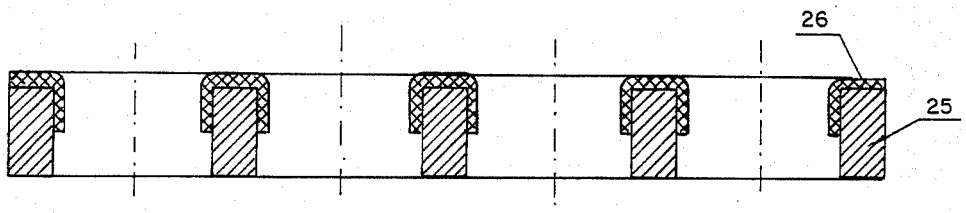

FIG. 11 shows a grate-like partition 23 which is composed of a non-wettable material, but its lower part is coated with a layer 24 of a wettable material, extending inside the openings and under the partition. In contrast, FIG. 12 shows a grate-like partition 25 which is composed of a wettable material, but its upper part is coated with a layer of a non-wettable material 26 extending inside the openings and above the partition.

The invention is not limited to the details shown since various modifications and structural changes are possible without departing in any way from the spirit of the present invention.

What is desired to be protected by Letters Patent is set forth in particular in the apended claims.

I claim:

1. A pipe for elevating a liquid by displacing liquid portions in an elevation direction with separation of said portions from one another by gas portions, the pipe comprising means forming a plurality of elongated passages extending in an elevation direction and located adjacent to one another in a direction which is transverse to said elevation direction, each of said passages having a cross section such that a stable meniscus film is formed between each liquid portion and a neighboring gas portion in each of said passages, each of said passages having a plurality of wall portions wettable by the liquid and a plurality of wall portion non-wettable by the liquid, wherein each of said wettable wall portions is located prior to a respective one of said non-wettable wall portions as considered in the elevation direction.

2. A pipe as defined in claim 1, wherein said elongated passages are interrupted in the direction of elevation and each includes a plurality of passage portions spaced from one another in the direction of elevation, said forming means including a plurality of liquid permeable partitions spaced from one another in the elevation direction and each forming one passage portion of one of said elongated passages and one passage portion of at least one more of said elongated passages, each of said partitions having openings which form said passage portions, each of said partitions having an upstream wall portion forming said wettable wall portion and a downstream wall portion forming said non-wettable wall portion.

3. A pipe as defined in claim 2, wherein each of said partitions is composed of a material non-wettable by the liquid, said upstream wall portion of each of said partitions being coated by a layer of a material wettable by the liquid, wherein said downstream portion of the same is exposed.

4. A pipe as defined in claim 2, wherein each of said partitions is composed of a material wettable by the liquid, said downstream portion of each of said partitions being coated by a layer of a material which is not wettable by the liquid., whereas said upstream wall portion is exposed.

5. A device for elevating a liquid by displacing liquid portions in an elevation direction with separation of said portions from one another by gas portions, the device comprising means forming a plurality of elongated passages extending in an elevation direction and located adjacent to one another in a direction which is transverse to the elevation direction, each of said passages having a cross section such that a stable meniscus film is formed between each liquid portion and a neighboring gas portion in each of said passages, each of said passages having a plurality of wall portions wettable by the liquid, and a plurality of wall portions non-wettable by the liquid, wherein each of said wettable wall portions is located prior to a respective one of said non-wettable wall portions as considered in the elevation direction; and means for providing a pressure differential which is sufficient for elevating the liquid portions separated by said gas portions in said elongated passages.

* * * * *